US007856845B2

(12) United States Patent
Fotiadis et al.

(10) Patent No.: US 7,856,845 B2
(45) Date of Patent: Dec. 28, 2010

(54) REFRIGERATING DEVICE

(75) Inventors: Panagiotis Fotiadis, Giengen (DE); Alexander Görz, Aalen (DE); Hans Ihle, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 700 days.

(21) Appl. No.: 11/919,281

(22) PCT Filed: Mar. 30, 2006

(86) PCT No.: PCT/EP2006/061188

§ 371 (c)(1),
(2), (4) Date: Oct. 24, 2007

(87) PCT Pub. No.: WO2006/120079

PCT Pub. Date: Nov. 16, 2006

(65) Prior Publication Data

US 2010/0218544 A1 Sep. 2, 2010

(30) Foreign Application Priority Data

May 10, 2005 (DE) ..... 10 2005 021 611

(51) Int. Cl.
*F25D 17/06* (2006.01)

(52) U.S. Cl. ..... 62/419; 62/407

(58) Field of Classification Search ..... 62/407, 62/419, 440, 449

See application file for complete search history.

(56) References Cited

U.S. PATENT DOCUMENTS

| | | | | | |
|---|---|---|---|---|---|
| 2,247,736 | A | * | 7/1941 | Tull | 62/288 |
| 2,306,480 | A | * | 12/1942 | Ketcham | 62/229 |
| 2,433,655 | A | * | 12/1947 | Di Zoppola | 62/163 |
| 3,025,683 | A | | 3/1962 | Baker et al. | |
| 4,879,881 | A | * | 11/1989 | Madigan | 62/447 |
| 5,678,421 | A | * | 10/1997 | Maynard et al. | 62/407 |
| 5,979,174 | A | | 11/1999 | Kim et al. | |

FOREIGN PATENT DOCUMENTS

| | | |
|---|---|---|
| FR | 2 639 424 | 5/1990 |
| JP | 2000-121230 | 4/2000 |
| RU | 2248316 C2 | 3/2005 |

OTHER PUBLICATIONS

International Search Report PCT/EP2006/061188.

* cited by examiner

*Primary Examiner*—Melvin Jones
(74) *Attorney, Agent, or Firm*—James E. Howard; Andre Pallapies

(57) ABSTRACT

The invention relates to a refrigerating device having a cooling compartment that can be closed by a door. The door has a heat insulated inner lining and a cooling air duct. The cooling air duct in the door conducts air cooled by an evaporator to the cooling compartment and the cooling air duct is recessed in the heat insulation of the door and is not covered by the heat insulation on the side facing the inner lining of the door.

7 Claims, 3 Drawing Sheets

REFRIGERATING DEVICE

Figure 1:
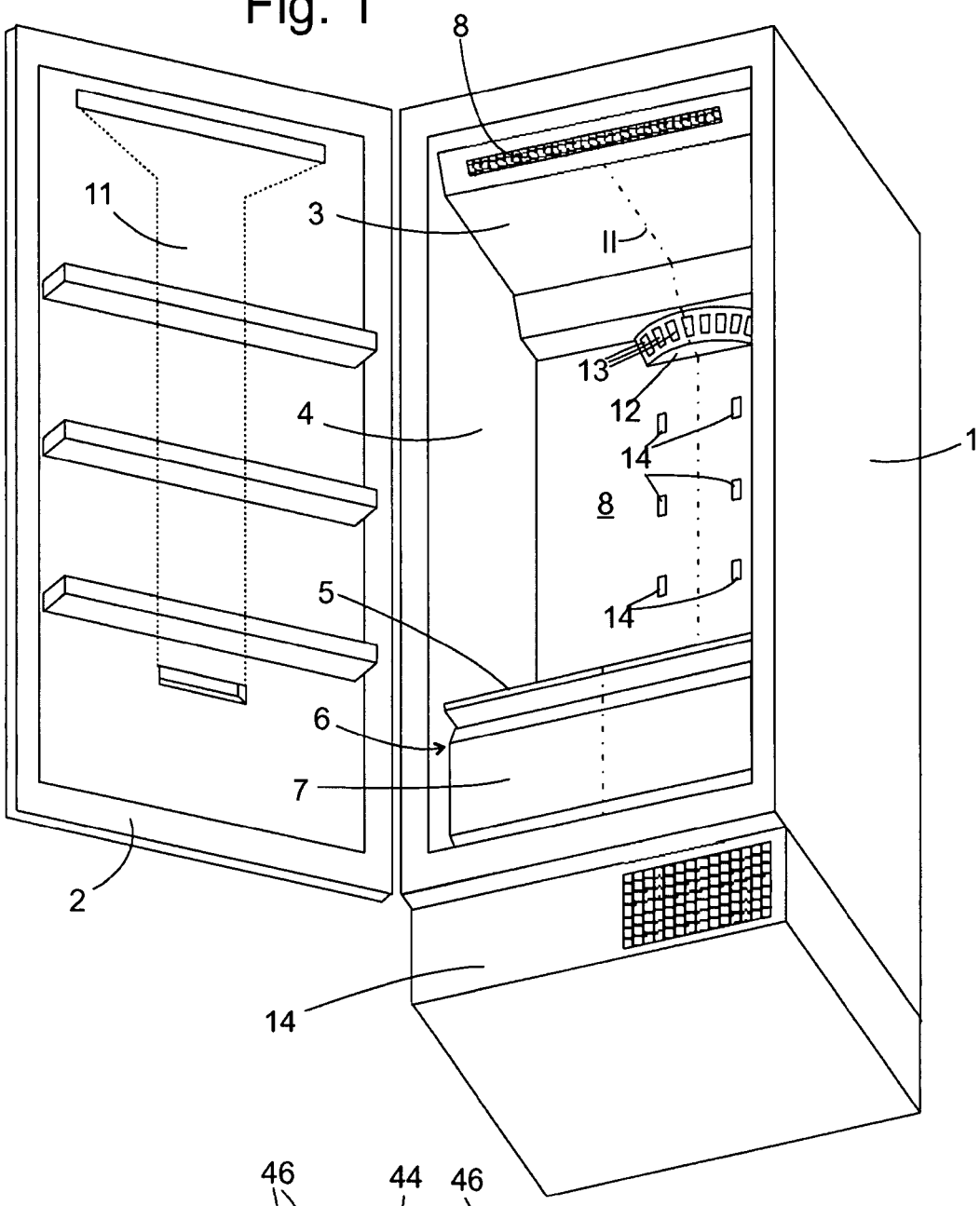

The invention relates to a refrigerator with at least one cooling compartment, which can be closed by a door, which features internal cladding and a cooling-air duct to which the cooling air cooled by an evaporator and circulated by a ventilator is supplied.

In refrigerators, especially no-frost refrigerators, in which the cooling compartments, such as fridge and/or freezer compartments are cooled by cold air forced to circulate by a ventilator, the cooling air is directed for different device variants into a cooling-air duct arranged in the door of these refrigerators which possess outlet openings distributed over the height of the door to cool refrigerated goods stored in the door using door storage compartments. With this direct cooling of the refrigerated goods using the cooling air flowing into the door storage compartments the problem arises of the goods stored there drying out prematurely. In addition there is the danger with this type of cooling of the door storage compartments of the air outlet openings of the air channel being blocked by refrigerated goods placed in the door storage compartments.

The object of the invention is to use simple constructional measures to avoid the disadvantages of the prior art.

The object is achieved in accordance with the invention such that the cooling-air duct in the door is cut away in its heat insulation and is embodied free of heat insulation through to the inner cladding of the door.

With this type of cooling-air duct in the door a cooling effect in accordance with the so-called "cold wall" is achieved, which means that the wall shielding the cooling-air duct from the cooling compartment serves as a heat exchanging surface so that cold air is not applied directly to refrigerated goods placed in the door. The cold emitted by radiation makes an even flow-free cooling of the door storage compartments and of the refrigerated goods in the door storage compartments possible. This also prevents a reduced cooling effect occurring as a result of covered cold air outlet openings in the door.

In accordance with a preferred embodiment of the subject matter of the invention there is provision for the cooling-air duct to be covered by the inner cladding through to cooling compartment. By using the inner cladding as a cover for the cooling-air duct this duct can be produced in an especially simple and cost effective way, since the cooling-air duct is created without additional wall sections during the manufacturing of the refrigerator door.

In accordance with an alternative embodiment of the subject matter of the invention there is provision for the cooling-air duct to be formed by a groove made in the inner cladding by deep drawing and to be covered by a cover through to the cooling compartment.

An especially even temperature distribution over the height of the door is produced, if according to a next preferred embodiment of the object of the invention there is provision for the cooling-air duct to be arranged at least essentially over the entire height of the door.

Through the indirect cooling effect of the inner door cladding through to the cooling compartment means that an even temperature distribution is also achieved within the cooling compartment, especially if the cooling air supply occurs at the upper end of the door.

It has proved especially good for the temperature distribution along the door height and within the cooling compartment for the cooling-air duct to exit at the lower end of the door.

In accordance with a further preferred embodiment of the object of the invention, there is provision for the cooling compartment to feature a cooling-air duct on its rear wall, on its roof and on its floor, of which the duct wall facing the cooling compartment serves as a heat exchanger surface for the cooling compartment.

An especially homogeneous temperature distribution within the cooling compartment is achieved by this type of cooling effect on the cooling compartment for example in combination with a central air outlet in the upper cooling compartment area or via a number of air outlets along a wall of the cooling compartment and the cooling-air duct in the door.

Figure 2:
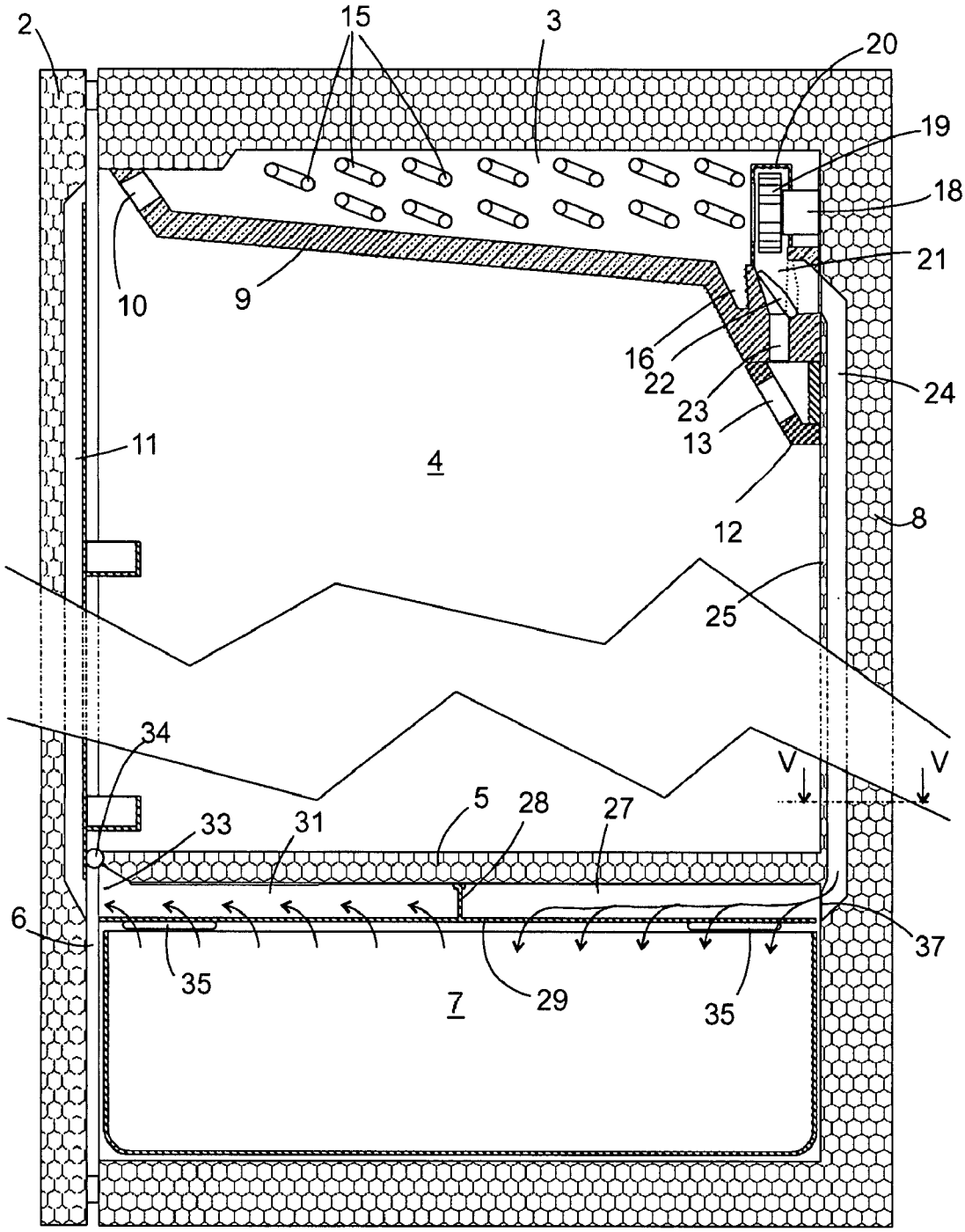
Figure 3:
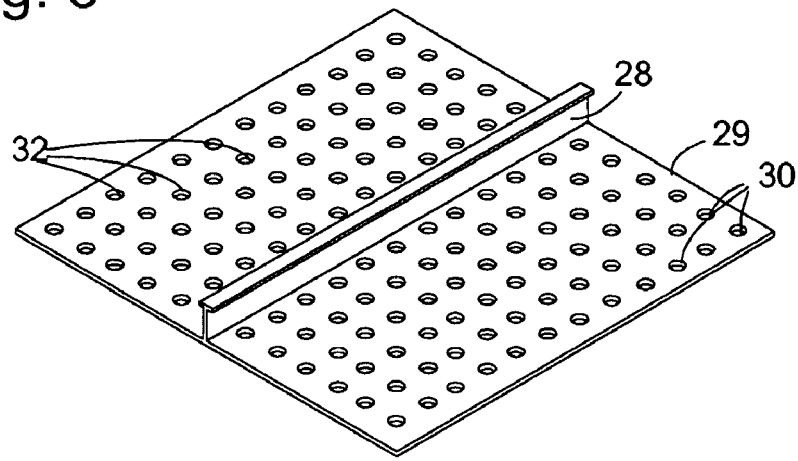
Figure 4:
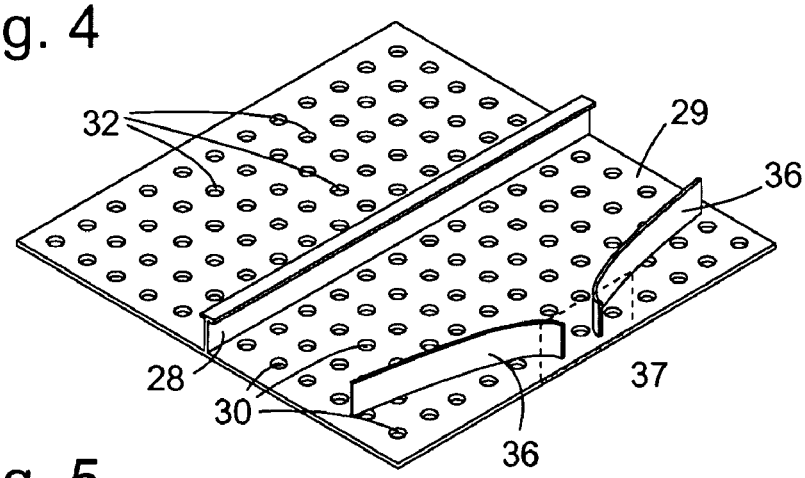
Figure 5:
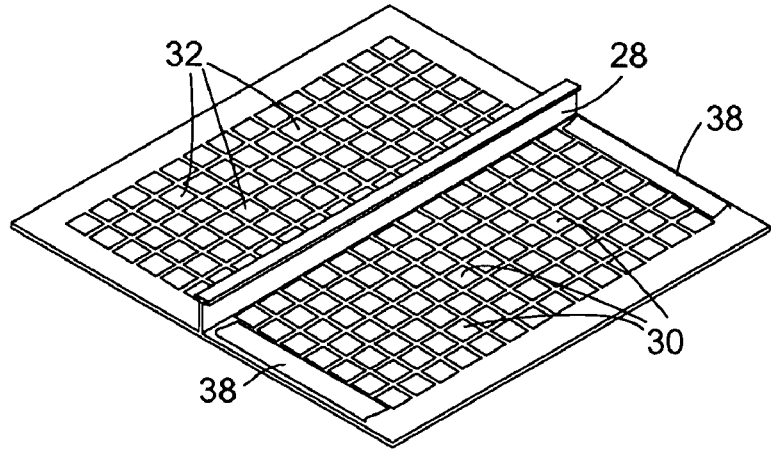

The figures show:

FIG. 1 a perspective of a refrigerator on which the present invention is realized;

FIG. 2 a section through the refrigerator of FIG. 1 along the line II from FIG. 1;

FIG. 3 a view of a first embodiment of first and second dividing wall;

FIG. 4 a view of a second embodiment of the dividing walls;

FIG. 5 a view of a third embodiment of the dividing walls; and

Figure 6:
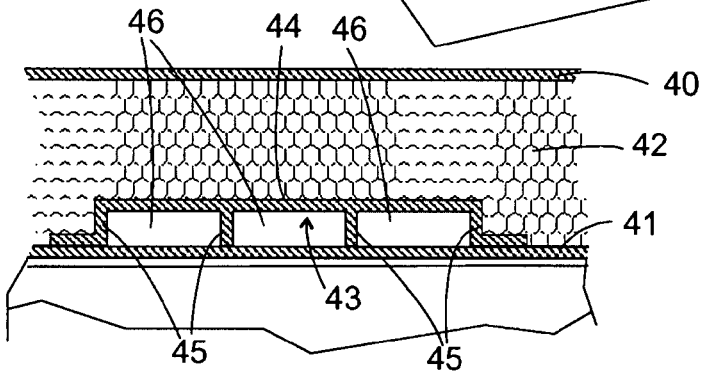

FIG. 6 a horizontal part section through the door of the refrigerator

FIG. 1 shows a perspective view of a so-called no-frost refrigerator, on which the present invention is to be explained. The device has a heat-insulating carcass 1 and a door 2. The interior of the carcass 1 is subdivided into an evaporator area 3 at the top below the roof of the carcass 1, a first cooling area 4 and, separated from this by an insulating partition wall 5, a second cooling area 6. A pull-out container 7 is accommodated in the second cooling area 6. The first cooling area 4 is divided up by a number of refrigerated goods carriers in compartments one above the other which are however omitted from the Figure.

On the front of a partition wall 9 (see FIG. 2) separating the evaporator area 3 from the first cooling area 3 an air inlet opening 10 is formed, through which air can enter from the first cooling area 4 into the evaporator area 3. Lines through which air can flow from the second cooling area 6 to the evaporator area 3, can—not visible in the Figure—run in side walls of the carcass 1; Another option shown in the Figure is an air duct 11 in the interior of the door 2, which begins at the height of the second cooling area 6 and ends opposite the air inlet opening 10, and the course of which is indicated in the Figure by dashed lines.

Adjacent to the rear wall 8 a distributor hood 12 is attached to the dividing wall 9, on which a plurality of air holes 13 is formed through which cold air moving out of the evaporator area 3 distributes itself into the upper part of the first cooling area 4 in various directions. Below the distribution hood 12 there are a number of pairs of openings 14 located on the rear wall 8, out of which cold air can also flow. The height of these pairs of openings 14 is selected so that, if refrigerated goods carriers are fitted in the first cooling area 4, each pair of openings 14 supplies one compartment.

FIG. 2 shows the refrigerator of FIG. 1 in a section along a center plane extending vertically and towards the bottom of the carcass 1, which is shown in FIG. 1 by a dotted and dashed line II. In the interior of the evaporator area 3 cooling slots of an evaporator 15 are to be seen in the section, onto which air penetrating through the air inlet opening 10 flows. The dividing wall 9 slopes towards the rear wall 8 of the carcass 1 into a gutter 16, in which water dripping from the evaporator 15 collects. The condensation water reaches an atomizer in the base area 17 (see FIG. 1) of the carcass via a pipe not shown in the diagram.

Behind the gutter 16, adjacent to the rear wall 8, is accommodated a fan which includes a motor 18, a fan blade wheel 19 driven by the motor and a housing 20. An induction opening of the housing 20 is formed on the front side of the housing in the axial direction of the fan wheel 19. The upper half of the housing 20 runs in the circumferential direction close to the fan wheel 19; the housing 20 is open at the bottom, so that a rotation of the fan wheel 19 causes air accelerated radially outwards to flow down out into a chamber 21.

A hinged flap 22 is accommodated in this chamber. At the point shown in the Figure the flap 22 blocks a cold air supply opening 23, which leads vertically downwards to the first cooling area 4. The air is in this way forced to the rear wall 8 and into a cold air supply path 24 which leads in the interior of the rear wall from the first cooling area 4 separated by a thin insulating layer 25, to the second cooling area 6. If the flap 22 hinged on a dividing wall 26 between the cold air supply opening 23 and the cold air supply line 24 is moved into the vertical position shown in the Figure as a dotted outline, it blocks off the cold air supply path 24, and the stream of cold air reaches the distribution hood 12 through the cold air supply opening 23. One of the air holes 13 can be seen in the figure, through which air flows out from the distribution hood 12 into the first cooling area 4.

The cold air supply path 24 leads to a cold air feed opening 37 of the second cooling area 6 and arrives there at a first distributor chamber 27, which runs transverse to the sectional plane of FIG. 2 over the entire width of the second cooling area 6 and over about half of its depth down to a vertical dividing wall 28. The vertical dividing wall 28 is formed in one piece with a horizontal dividing wall 29 made of plastic. The horizontal dividing wall 29 forms the floor of the first distribution chamber 27 and divides this of from a storage zone of the second cooling area lying below it. It is provided with a plurality of openings 30 (see FIG. 3), via which cold air fed to the distribution chamber 27 via the supply path 24 is distributed over a wide area into the storage zone and enters the pull-out container 7 open at the top accommodated therein.

A second distribution chamber 31 is located as a mirror image to the first distribution chamber 27 between the vertical dividing wall 28 and the door 2. The widened-out upper edge of the dividing wall 28 resting on the dividing wall 5 between the cooling areas 4 and 6 separated the distribution chambers 27, 31 from each other and prevents or restricts a direct overflow of cold air from the chamber 27 into the chamber 31. To create an effective air block between the chambers 27, 31, the upper edge of the dividing wall 28 can be provided with a sealing strip not shown in the Figure which is pressed between it and the partition wall 5 and makes a tight seal. However a narrow gap between the upper edge of the dividing wall 28 and the partition wall 5 can be accepted provided the airflow through this gap remains small in relation to that flowing from the first distribution chamber 27 into the pull-out container 7.

From the pull-out container 7 the air flows through openings 32 which are formed in the horizontal dividing wall 28 between the storage zone and the second distribution chamber 31, into the latter.

Opposite an air outlet opening 33 on the side of the second distribution chamber 31 facing the door 2 lies an inlet opening of the air line 11 running through the door 2 back to the evaporator area 3. A sealing strip 34 attached to the front edge of the partition wall 5 and compressed between this and the door 2 prevents an overflow of air from the distribution chamber 31 into the first cooling area 4 and ensures thereby that cold air can be applied separately and without mutual interference to the two cooling areas 4, 6.

The component forming the dividing walls 28, 29 is fitted into the second cooling area 6 so that it can be removed; in the case considered here its side edges rest on bars 35 which protrude from the side walls of the second cooling area 6 by a few millimeters in each case. This gives the user the option, of removing the dividing walls 28, 29 and filling the pull-out containers 7 up to their top edge and beyond with refrigerated goods should this be necessary.

FIG. 3 shows a perspective view of the component forming the dividing walls 28, 29 in accordance with a first embodiment. The vertical dividing wall 28 divides the horizontal 29 in two part surfaces of equal size in which the openings 30 or 32 are distributed in a regular pattern. In the modified embodiment of FIG. 4 two curved ribs 36 extending into the first distribution chamber 27 are formed on the horizontal dividing wall 29, which serve to deflect a part of the cold air flow passing through the cold air feed opening 37 shown in the drawing as a dashed outline on the lower end of the cold air supply path 24 into the first distribution chamber 27 to the side, in order to achieved in this way and even distribution of the air throughput to the openings 30 or possibly even a slightly higher throughput at the number of openings 30 into the rear wall 8.

To achieve a similar affect it would also be possible as a result of a variation not shown to vary the density or cross-sectional surface of the openings 30 beyond the horizontal dividing wall 29 in the downwards direction of the carcass 2, especially to make the openings 30 or 32 in the vicinity of the rear wall 8 or the door 2 larger than in the vicinity of the vertical dividing wall 28.

In the embodiment shown in FIG. 5 the openings 30, 32 are made large enough, for the horizontal dividing wall 29 to be reduced to a grid to a certain extent. To distribute the air flowing out of the distribution chamber 31 evenly over the surface of the dividing wall 29 here a rectangular piece of fleece or fabric not shown in the figure is provided here as a means for creating a flow resistance, which covers the openings 30 and is held in place with the aid of elastic clips 38. In order to also evenly distribute the outflow of air into the second distribution chamber 31 through the openings 32, a piece of fleece or fabric can also be attached to this.

FIG. 6 shows parts of a horizontal section through the door 2. In the conventional manner the door 2 has a rigid outer skin 40 a rigid inner skin 41 and an insulating layer 42 filling the cavity between the layers. In this insulation layer 42 there is a protruding extruded profile 43 attached to the inner skin 41, glued to it for example. The extruded profile 43 has a base 44 facing the outer skin 40, from which, distributed in the width direction, four bars 45 protrude. The extruded profile 43 together with the inner skin 41 delimits three channels 46, which jointly form the air duct 11. Since this air duct 11 runs directly along the inner skin 41 the air circulating in it, if it is colder than the first cooling area 4, can additionally cool regions of the first cooling area 4 close to the door which are conventionally cooled less well than regions close to the rear wall 8, and thus contribute to an especially even temperature distribution in the first cooling area 4.

The invention claimed is:

1. A refrigerator comprising:

a.) a housing in which a first cooling zone and an evaporator zone are disposed, the housing delimiting an access opening through which access to the first cooling zone can be had;

b.) a door movable between an open position in which the first cooling zone can be accessed via the access opening and a closed position in which the door closes the access opening such that the first cooling zone cannot be accessed via the access opening, the door having a heat insulated portion and an interior cladding with the interior cladding being located between the heat insulated portion and the access opening when viewed in the closed position of the door;

c.) means for driving a cold air flow from the evaporator zone; and d.) at least one door-extending distributor duct that extends along the door and has at least one door duct opening communicated with a cooling zone, the at least one door-extending distributor duct being operable to receive cold air that has been driven out of the evaporator zone via the means for driving a cold air flow and to distribute the received cold air into the cooling zone communicated with the at least one door duct opening, the at least one door-extending distributor duct being located relative to the heat insulated portion of the door and the interior cladding of the door such that none of the heat insulated portion extends between the at least one door-extending distributor duct and the interior cladding of the door, whereupon cold air flowing through the at least one door-extending distributor duct acts to cool the interior of the refrigerator via cooling of the interior cladding of the door directly adjacent to the at least one door-extending distributor duct.

2. The refrigerator as claimed in claim 1, wherein the at least one door-extending distributor duct is covered by the interior cladding through to the cooling compartment.

3. The refrigerator as claimed in claim 1, wherein the at least one door-extending distributor duct is arranged at least essentially along the full height of the door.

4. The refrigerator as claimed in claim 1, wherein the at least one door duct opening of the at least one door-extending distributor duct exits at a lower end of the door.

5. The refrigerator as claimed in claim 1, wherein the at least one door-extending distributor duct is configured as a shaped profile arranged in the heat insulated portion of the door together with the interior cladding.

6. The refrigerator as claimed in claim 5, wherein the shaped profile is configured as an extruded profile with a comb-like cross-section having comb teeth, the comb teeth resting on the interior cladding and the spaces between the comb teeth forming cooling air ducts.

7. The refrigerator as claimed in claim 1, wherein the cooling compartment has a door-extending distributor duct on a rear wall, a roof and a floor thereof and the respective door-extending distributor duct facing the cooling compartment acts as a heat exchanger surface for the cooling compartment.

* * * * *